United States Patent [19]

Fujiki

[11] Patent Number: 4,972,910

[45] Date of Patent: Nov. 27, 1990

[54] EXTINGUISHING APPARATUS

[76] Inventor: Masaru Fujiki, Dwelling Todoroki 303, 32-11, Todoroki 2-chome, Setagaya-ku, Tokyo, Japan

[21] Appl. No.: 497,895

[22] Filed: Mar. 22, 1990

[51] Int. Cl.[5] ..... A62C 11/00

[52] U.S. Cl. ..... 169/60; 169/83; 169/88

[58] Field of Search ..... 169/54, 56, 60, 26, 169/29, 30, 71, 83, 88

[56] References Cited

U.S. PATENT DOCUMENTS

| | | | |
|---|---|---|---|
| 1,634,976 | 7/1927 | Burke | 169/88 |
| 1,675,232 | 6/1928 | Straubhaar | 169/88 |
| 1,988,637 | 1/1935 | Tinkham | 169/88 |
| 2,496,160 | 1/1950 | Hesson | 169/30 |
| 3,005,495 | 10/1961 | Herberg | 169/88 |
| 3,802,511 | 4/1974 | Good | 169/30 |
| 4,899,826 | 2/1990 | Penn | 169/30 |

*Primary Examiner*—Sherman Basinger
*Assistant Examiner*—Stephen P. Avila
*Attorney, Agent, or Firm*—Frishauf, Holtz, Goodman & Woodward

[57] ABSTRACT

The extinguishing apparatus of this invention comprises a cartridge casing provided with a jet nozzle device, a flexible extinguishing liquid cartridge which is coupled in plug-in manner to the jet nozzle device by inserting from the open end of the cartridge casing into the interior of the casing, a cap for closing the open end of the casing, a joint for coupling the interior and exterior of the cartridge casing, and a discharge unit for coupling by plug-in manner to the joint. The cartridge is made possigle to discharge the extinguishing material, when it is compressed by a force from the outside, and the discharge unit feeds incombustible high pressure gas into the cartridge casing either automatically when the temperature of environment is reached over a predetermined temperature, or by handling manually. Aaccording to this, the cartridge is compressed, the extinguishing material discharged from the cartridge is jetted from the jet nozzle device.

8 Claims, 10 Drawing Sheets

EXTINGUISHING APPARATUS

BACKGROUND OF THE INVENTION

1. Field of the Invention

The present invention relates to an extinguishing apparatus capable of detecting a heat and automatically jetting an extinguishing material and also capable of jetting the extinguishing material manually.

2. Description of the Related Art

Extinguishing apparatus of this kind is disclosed in Japanese Provisional Patent Application No. 61-37267 which has already been filed by an applicant of this application. This known extinguishing apparatus is provided with a cartridge casing which is hollow cylindrical in shape and is opened in its both ends. Both opening ends of this casing are respectively closed by front and rear caps. A cartridge charged with extinguishing liquid is contained within the casing, and this cartridge is formed with tube having flexibility. Further, a screw-in type connector is provided at one end of this cartridge, and this connector is protruded to outside through the front cap. A jet nozzle for extinguishing material is connected to the protruded end of the connector.

On the other hand, a discharge unit contained with a high pressure bomb is arranged to the exterior of the cartridge casing, and a conduit pipe is extended from this discharge unit. An end of this conduit pipe is detachably coupled with rear cap of the cartridge whereby being connected with interior of casing. Incombustible high pressure fluid is charged in the pressure bomb, and the high pressure fluid within this pressure bomb is made either to be discharged manually or to be discharged automatically by detecting a heat. Accordingly, when the high pressure fluid is discharged from the discharge unit, that is, from the pressure bomb, this high pressure fluid flows through the conduit pipe into the cartridge casing whereby becoming to compress the cartridge. Consequently, the extinguishing liquid within this cartridge is pressed out of the cartridge and thereby being jetted from the jet nozzle.

By the way, in aforementioned known extinguishing apparatus, after the extinguishing liquid within the cartridge is exhausted, not only the exhausted cartridge within the casing is changed with new cartridge, but the exhausted high pressure bomb, i.e., discharge unit is also changed with new discharge unit. However, in the changing of these cartridge and high pressure bomb, it takes very much process and time, and in case of known extinguishing apparatus, there is inconvenience that its successive using can not be rapidly carried out. That is, the cartridge is coupled in screwing manner with jet nozzle through the connector passed through the front cap, and the front cap is also fixed in screwing manner to the casing, and therefore in order to change the cartridge, these coupling of screwing manner has to be respectively released between the connector and jet nozzle as well as between the front cap and casing, and thereafter the coupling of these screwing manner should be accomplished again.

And, with respect to the changing of discharge unit, it takes rather process for releasing and coupling of the conduit pipe from and to the rear cap. Further, as aforementioned, in order to enable the discharging of high pressure fluid from the discharge unit by manual as well, for example, relation between the manual handling member of trigger etc. and the discharge unit is in a state of mechanically coupled, and therefore it is required to execute the releasing or coupling between the manual handling member and discharge unit for the changing of discharge unit.

SUMMARY OF THE INVENTION

Therefore, it is an object of the present invention, in the extinguishing apparatus of above-described type, to provide an extinguishing apparatus in which the changing of discharge unit contained with high pressure bomb and cartridge of extinguishing material can be rapidly executed and successive using of the apparatus becomes possible.

Above-described object is accomplished by the extinguishing apparatus of this invention, and this extinguishing apparatus comprises:

a hollow cartridge casing, said cartridge casing having a closed end and an opened end;

a jet nozzle device mounted to the closed end of said cartridge casing, said jet nozzle device including a discharge pipe extending into the cartridge casing by passing through the closed end of said cartridge casing in air tight manner from outside, and at least one jet nozzle mounted to a protruded portion of the discharge pipe from said cartridge casing;

a cartridge inserted from the open end of said cartridge casing therein, said cartridge including a flexible tube closed with both ends, extinguishing material having fluidity charged within the tube, discharge outlet protruded from an end of the tube positioned at the discharge pipe side in the inserted state of said cartridge into the interior of said cartridge casing, and sealing means for blocking the discharge outlet, and for opening the discharge outlet when said cartridge is compressed by a predetermined force from exterior;

connecting means for coupling detachably the discharge outlet of said cartridge in plug-in manner to the discharge pipe of said jet nozzle in case when said cartridge is inserted to the interior of said cartridge casing;

a cap for closing the opened end of said cartridge casing which is detachably mounted in screwing manner to the open end of said cartridge casing;

a joint pipe mounted to the external wall of said cartridge casing, of which one end is opened to the interior of said cartridge casing and another end is opened to the exterior of said cartridge casing;

a discharge unit for discharging incombustible high pressure fluid through said joint pipe into said cartridge casing in case when detecting a predetermined temperature, said discharge unit including a hollow unit casing, joint means for detachably coupling said unit casing in-plug in manner to said joint pipe, a high pressure bomb contained within the unit casing, and being charged with high pressure fluid therein as well as having a closed outlet for discharging the high pressure fluid, and a releasing means of heat responsive type for opening the closed outlet of the high pressure bomb by operating when the temperature of environment would be reached over a predetermined temperature, the releasing means having a heat sensitive operational section exposed at the exterior of the unit casing;

holding means for detachably holding said discharge unit connected with said joint pipe to said cartridge casing; and trigger means which is mounted separately with said discharge unit, and which may be actuated by the manual handling of the heat sensitive operational section of said releasing means regardless of temperature.

According to above-described extinguishing apparatus, in case when either the temperature of environment is reached over a predetermined temperature, or said trigger means is operated by manual handling, the releasing means is operated and then the closed outlet of high pressure bomb is opened. Accordingly, incombustible high pressure fluid is discharged within the unit casing from the high pressure bomb, and the high pressure fluid is fed from the unit casing through said joint pipe into said cartridge casing. Therefore, the pressure in said cartridge casing is increased, and thereby said cartridge is compressed. Consequently, the discharge outlet of said cartridge is opened, and the extinguishing material is flowed out from said cartridge into said cartridge casing, and then supplied to said jet nozzle through the discharge pipe. As a result, the extinguishing material is delivered from said cartridge casing into the discharge pipe and jetted out of said jet nozzle.

In the extinguishing apparatus of this invention, since said cartridge is coupled in plug-in manner to the discharged pipe by said connecting means, after the extinguishing material within the cartridge is exhausted, said exhausted cartridge can be removed from said cartridge casing by only drawing out of said cartridge casing, after said cap of said cartridge casing is removed. Thereafter, new cartridge can be connected to the discharge pipe only by inserting said new cartridge into said cartridge casing, and then, the changing of said cartridge can be rapidly finished by mounting again said cap to said cartridge casing.

On the other hand, said discharge unit is also coupled in plug-in manner to said joint pipe by the joint means as in the case of aforementioned cartridge, and said discharge unit and said trigger means are separated one another, and therefore, the changing of said discharge unit can be rapidly executed, if the high pressure fluid of high pressure bomb is exhausted.

Therefore, in case of the extinguishing apparatus of the present invention, since the exchanging of said cartridge and said discharge unit being of articles of consumption can be rapidly executed, and successive using of the extinguishing apparatus becomes possible by preparing previously a large number of these cartridge and discharge unit.

Other advantages of this invention will become clear from the description of a preferred embodiment with reference to the accompanying drawings hereinafter.

DETAILED DESCRIPTION OF THE PREFERRED EMBODIMENTS

Figure 1:
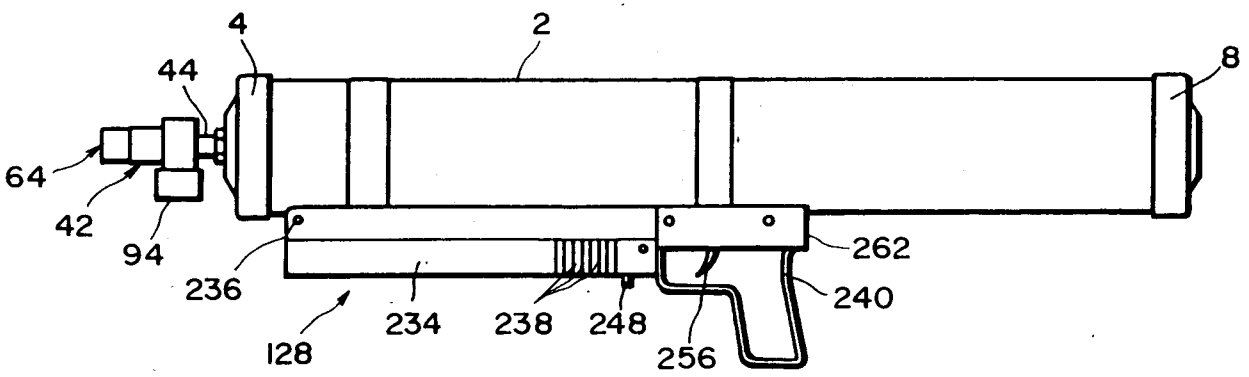
FIG. 1 is a side view of an extinguishing apparatus according to a preferred embodiment of the present invention.

Referring to FIG. 1, an extinguishing apparatus according to a preferred embodiment of this invention is shown. This extinguishing apparatus is provided with cartridge casing 2, of which cartridge casing 2 is formed with hollow cylinder opened with both ends as shown in detail in FIG. 2. A front cap 4 is coupled in screwing manner to an open end of the cartridge casing 2 located at left side in viewing in FIG. 2, and closes the open end of the casing 2. A packing 6 is sandwiched between the front cap 4 and the open end of the casing 2, and seals the gap between the front cap 4 and the open end in the airtight manner. On the other hand, a rear cap 8 is coupled in screwing manner to the other open end of the casing 2 as well, and closes the other open end of the casing 2 in the airtight manner. The rear cap 8 comprises an inner cap 10 inserted into the cartridge casing 2, an outer cap 12 coupled in screwing manner to the other open end of the casing 2, and a sealing member 14 sandwiched between these inner and outer caps 10 and 12. Further, the inner cap 10 and outer cap 12 are coupled together by means of a coupling disc 16 and a coupling screw 18, and an O-ring 20 for sealing a gap between the inner cap 10 and the inner surface of casing 2 is mounted on the outer surface of the inner cap 10.

Figure 2:
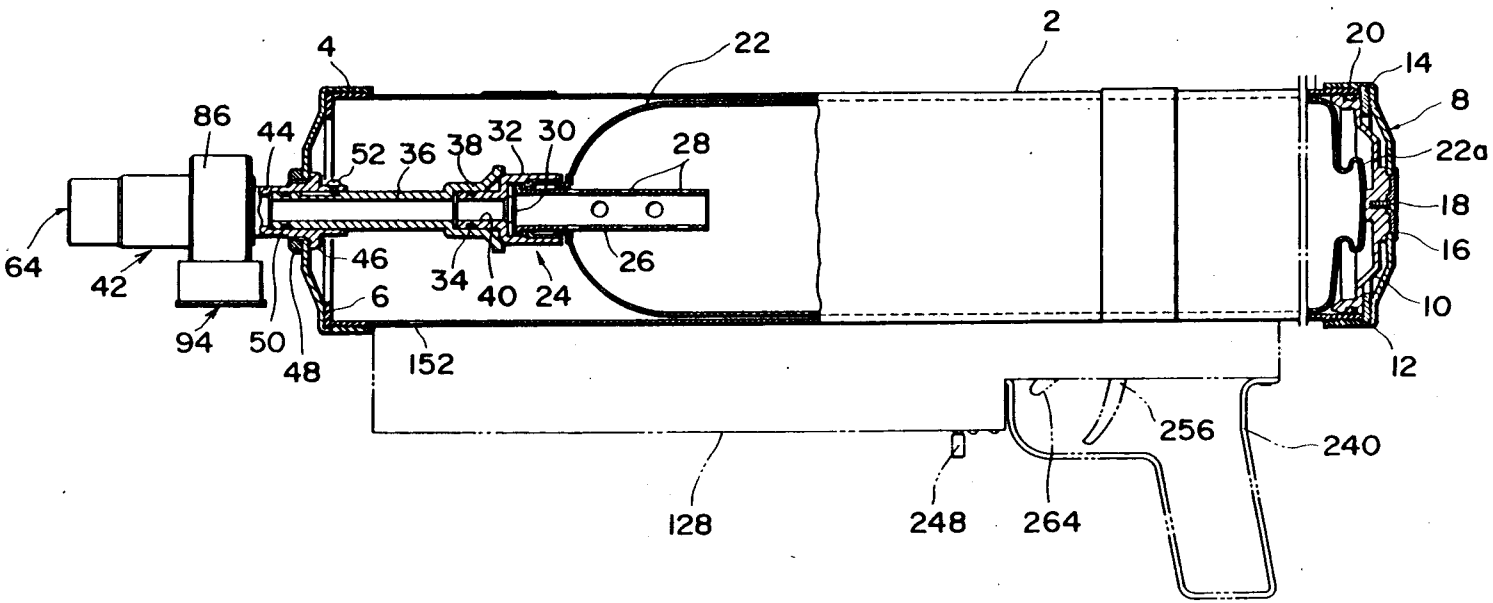
FIG. 2 is a side view for showing a cartridge casing of the extinguishing apparatus of FIG. 1 which is partly cut out.

A cartridge 22 charged with extinguishing liquid is contained within the cartridge casing 2. This cartridge 22 is made of flexible tube closed with both ends. A predetermined gaps are provided between the cartridge 22 and the inner surface of the casing 2. The cartridge 22 is supported by the rear cap 8 in case that the cartridge 22 is inserted into the casing as shown in FIG. 2.

In the cartridge 22, a knob **22*a* is protruded from one end located at the rear cap side, and a discharge head 24 for extinguishing liquid is provided on the other end located at the front cap side. This discharge head 24 has a discharge pipe 26 which is located in coaxial with cartridge 22 and protruded from the interior of cartridge 22 to the exterior in the liquidtight manner. A plurality of openings 28 are formed in the portion of the discharge pipe 26 located within the cartridge 22, and an opening end of the discharge pipe 26 protruded from the cartridge 22 is blocked by sealing film 30. This sealing film 30 has a strength so as not to be broken down as far as the cartridge 22** is compressed with a predetermined pressure from the outside.

Further, a connector plug 32 is mounted on the protruded portion of the discharge pipe 26. This connector plug 32 is made of pipe member formed of stepped shape, and the protruded portion of the discharge pipe 26 is liquidtightly inserted into the interior of the large diameter portion of connector plug 32. The small diameter portion of the connector plug 32 is extended to form the extended portion of the discharge pipe 26, and an O-ring 34 is provided at its front end of the connector plug 32.

On the other hand, a connecting pipe 36, in which a discharge passage for the extinguishing liquid is defined, is arranged within the cartridge casing 2 in cooperate with the connector plug 32. This connecting pipe 36 is positioned in coaxial with the connector plug 32, i.e., the discharge pipe 26, and one end of the connecting pipe 36 located at the connector plug 32 side is formed as a socket portion 38 for the connector plug 32. That is, the socket portion 38 is formed with a socket hole 40 in which the small diameter portion of the connector plug 32 can be inserted. This insertion is guided by the funnel-like open end of the socket portion 38. The other end portion of the connecting pipe 36 is connected to the jet nozzle device 42 for extinguishing liquid, i.e., to the inlet pipe 44 of this jet nozzle device 42. The inlet pipe 44, as shown in FIG. 2, is formed of a pipe member which has large diameter than the connecting pipe 36 and passes through the front cap 4 from outside and thereby extending into the casing 2. A flange 46 is formed on its outer peripheral surface of the inlet pipe 44 and located within the cartridge casing 2. Further, a male screw portion is formed on the inlet pipe 44 so as to extend from the flange 46 to the outside of the casing 2. Accordingly, the inlet pipe 44 is fixed to the front cap 4 by means of a nut 48 screwed on to the the male screw portion.

The connecting pipe 36 is connected to the inlet pipe 44 by inserting the other end portion of the inlet pipe 44 into the inlet pipe 44. A O-ring 50 is mounted on the other end portion of the connecting pipe 36, and also this connecting pipe 36 and the inlet pipe 44 are coupled together by set screw 52.

Figure 3:
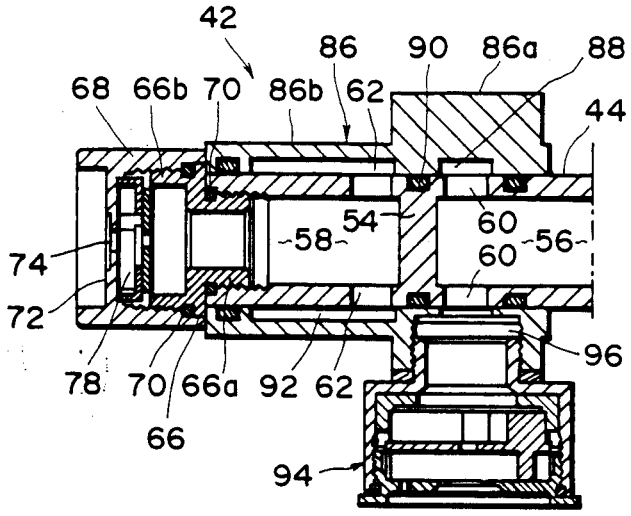
FIG. 3 is a cross sectional view of jet nozzle device.
Figure 4:
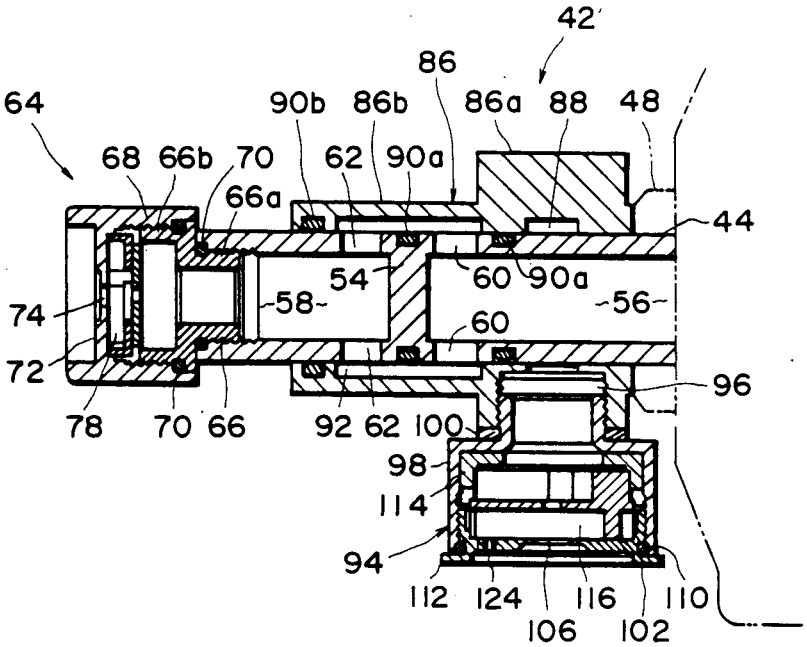
FIG. 4 is a cross sectional view of jet nozzle which is different in using condition.

Referring to FIGS. 3 and 4, detail of aforementioned jet nozzle device 42 is shown, and hereinafter, it will be described with regard to this jet nozzle device 42. In the inlet pipe 44, a partitioning wall 54 is integrally formed at the interior of the front end portion protruded from the front cap 4. The partitioning wall 54 partitions the interior of the inlet pipe 44 into a rearward passage 56 communicating with the connector plug 32 and a forward passage 58 of the front end side of the inlet pipe 44.

Further, a plurality of ports 60 close to the partitioning wall 54 and communicating with the rearward passage 56 and a plurality of ports 62 close to the partitioning wall 54 and communicating with the frontward passage 58 are formed on the outer peripheral surface of the inlet pipe 44, respectively.

A frontward jet nozzle 64 is mounted on the front end of the inlet pipe 44 and is provided with inner and outer bodies 66 and 68. The inner body is formed of a stepped hollow pipe member and the outer body 68 is formed of a stepped hollow pipe member. The small diameter portion **66*a* of the inner body 66 is screwed into the front end opening of the inlet pipe 44 and its large diameter portion 66*b* is screwed into the outer body 68. O-rings 70 are disposed between the inner body 66 and the inlet pipe 44 as well as between the inner body and the outer body 68**, respectively.

Figure 5:
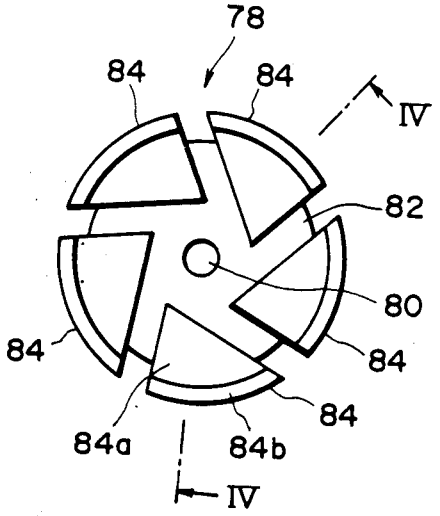
FIG. 5 is a plan view of spray disc contained within forward jet nozzle.
Figure 6:
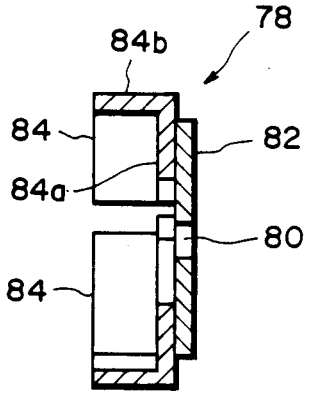
FIG. 6 is a cross sectional view taken along a line VI—VI in FIG. 5.

A partitioning wall 72 is formed in the interior of the outer body 68, and jet nozzle hole 74 is formed at the center of this partitioning wall 72. A spray disc 78 is disposed between the partitioning wall 72 and the large diameter portion **66*b* of the inner body 66. As shown in FIGS. 5 and 6, the spray disc 78 is formed with circular plate 82 having a through hole 80 at its center, and a plurality of spray fins 84 disposed at equal intervals in the circumferential direction of the circular plate 82 on the one side surface thereof, i.e., on the surface of partitioning wall 72 side. These spray fins 84 are formed with sector plate pieces 84*a* and circular arc walls 84*b* formed integrally at circumferential edges of this plate pieces 84*a***.

A slider 86 is mounted on the inlet pipe 44 so as to cover aforementioned ports 60 and 62. This slider 86 is made of cylindrical member formed with stepped shape. An annular groove 88 communicating with the ports 60 in case that the slider 86 is located at the position shown in FIG. 3 is formed on the inner surface of the large diameter portion **86*a* of the slider 86. A pair of O-rings 90*a* located at the both sides of the ports 60 are mounted on the inlet pipe 44, while an O-ring 90*b* is mounted on the front end portion of the small diameter portion 86*b* of the slider 86. Further, an annular groove 92 is also formed on the inner surface of the small diameter portion 86*b*. The annular groove 92 has a predetermined width so that when this annular groove 92 is in a state of FIG. 3, the ports 62 communicate with the right end of the annular groove 92 and when the slider 86 is moved to rightward as shown in FIG. 4, the ports 60 and 62 respectively communicate with the right and left ends of the annular groove 92 at the same time. Accordingly, in case when it is in a state of FIG. 4, between the ports 60 and 62 are connected one another through the annular groove 92, while the connection between the annular groove 88 and the ports 60** is closed.

Figure 7:
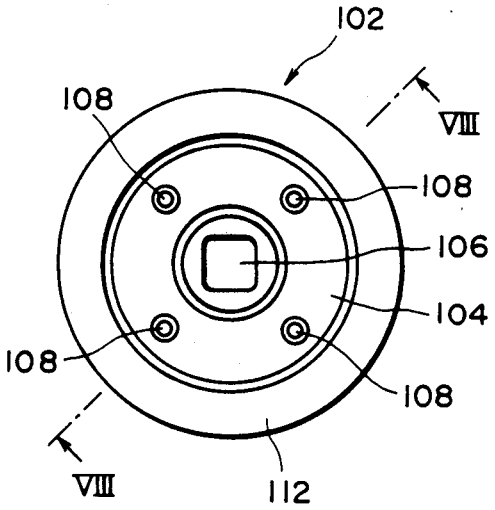
FIG. 7 is a front elevational view of jet disc of downward jet nozzle.
Figure 8:
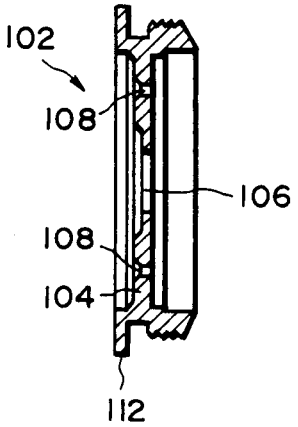
FIG. 8 is a cross sectional view taken along a line VIII—VIII in FIG. 7.

A downward jet nozzle 94 is mounted on the large diameter portion **86*a* of the slider 86. That is, a threaded opening 96 opened to downward is formed on the outer surface of the large diameter portion 86*a* and communicated with the annular groove 88. The downward jet nozzle 94 includes a body 98 formed with hollow and cylindrical shape. The body 98 is screwed into the threaded opening 96 through a sealing 100. This body 98 has a lower portion which is protruded from the slider 86 and broadened in diameter. A jet disc 102 is screwed into the lower end opening of the body 98. This jet disc 102 is formed with ring shape, having a through hole at its center as shown in FIGS. 7 and 8, and a partitioning wall 104 is formed in the through hole at the center of the axial direction thereof. A rectangular jet hole 106 is formed at center of this partitioning wall 104, and four circular holes 108 are formed around the jet hole 106 on the partitioning wall 104. Further, an O-ring 110 is provided between the jet disc 102 and the body 98 and a flange 112 larger than the diameter of the body 98 and abutting to the lower edge of this body 98 is integrally formed at outer end of the jet disc 102**.

A spray disc 116 is contained within the body 98 so as to be sandwiched between the jet disc 102 and a spacer ring 114. This spray disc 116 has a through hole 118 at its center as shown in more detail in FIGS. 9 to 11, and four protrusions 120 are integrally formed on the one end surface of of the spray disc 116 at the jet disc side so as to be apart from each other in the circumferential direction of the jet disc 116. Screw holes 122 are formed in the protrusions 120 at positions corresponding to the holes 108 of the jet disc 102. Therefore, the spray disc 116 is coupled to the jet disc 102 by screwing screws 124 into the screw holes 122 through the holes 108 of the jet disc 102. Further, a plurality of grooves 126 extending spairally from the through hole 118 are formed on the other end surface of the spray disc 116.

A feeding device 128 for feeding the high pressure fluid into the interior of this casing 2 is mounted at the lower portion of the cartridge casing 2. This feeding device 128 is provided with a joint 130 fixed to the front end portion of the casing 2 as shown in detail in FIG. 12. This joint 130 has a fixed tube 132 of which one end is protruded in airtight manner into the interior of the casing 2, and another end is extended to downward. The fixed tube 126 is made of stepped pipe member gradually broadened in its outer diameter to downward, of which top end is held by means of nut 134 to the inner wall of the casing 2. A larger diameter hole 136 is formed in the lower end portion of the fixed tube 132, and a receiving seat 138 is mounted at the opening end of the hole 136. The joint 130 further has a movable tube 140. The one end portion of the movable tube 140 is formed as a ball 142. The ball 142 is fitted in the hole 136 and held between the receiving seat 138 and the inner surface of the hole 136 so as to be able to rotate. Another end side portion of the movable tube 140 is protruded to rearward of the casing 2 through a slit 144 of the fixed tube, of which end portion is formed as a socket 146. The slit 144 is extended to downward and defines the rotational direction of the movable tube 140. That is, the movable tube 140 can rotates only to up and downward.

The internal passage 148 of the movable tube 140 is bent toward radial direction within the ball 142 and opened in the outer surface of the ball 142, thereby being connected to the internal passage 150 of the fixed tube 132. Further, in FIG. 2, only a hole 152 for inserting the fixed tube 132 into the interior of the casing 2 is shown.

A discharge unit 154 of high pressure fluid is connected to the joint 130, i.e., to the movable tube 140. The discharge unit 154 has a unit casing 156 formed with hollow cylindrical shape as shown in detail in FIG. 13, and one side opening end of the unit casing 156 is closed by a connector cap 160 through a packing 158 in airtight manner. A connector pipe 162 is protruded on the outer surface of the connector cap 160 and positioned in coaxial with the unit casing 156. The connector pipe 162 be detachably inserted into the socket 146 of the movable tube 140. The connector pipe 162 is communicated with the interior of the unit casing 156 through a through hole 164 formed at the center of the packing 158 in one side, and communicated with the interior of the cartridge casing 2 through the joint 130 in the another side. An O-ring 166 is provided at the front end portion of the connector pipe 162, therefore, the joint 130 and the connector pipe 162 can be coupled in airtight manner by the O-ring 166.

A closing cap 170 is coupled in screwing manner through a packing 168 to another end opening of the unit casing 156.

A high pressure bomb 172 charged with incombustible high pressure fluid is contained within the unit casing 156. The mouth portion 174 of the high pressure bomb 172 is directed to the closing cap side and closed by a breakable seal 176. The mouth portion 174 of the high pressure bomb 172 is screwed into a supporting pipe 178. The supporting pipe 178 penetrates through the packing 168 and the closing cap 170 in airtight manner. A flange portion **178*a* slightly broadened in diameter is formed on the outer surface of the supporting pipe 178 located within the closing cap 170. The flange portion 178*a* is contact with a stepped surface 170*a* formed in the inner surface of the the closing cap 170. Accordingly, the through hole 164 of the packing 158 is never closed by the high pressure bomb 172 due to that the supporting tube 178 is moved to leftward in viewing of FIG. 13**.

Figure 14:
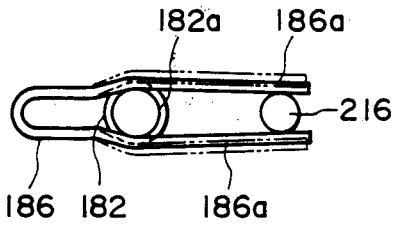
FIG. 14 is a plan view of retainer.

The internal passage of the supporting pipe 178 is formed as a stepped hole 180 reduced in diameter at a remote side portion from the mouth portion 174 of the high pressure bomb 172, and an actuator rod 182 is slidably inserted into the small diameter portion of the stepped hole 180. One end portion of the actuator rod 182 is protruded from the supporting pipe 178, and this protruded and portion is held by a retainer 186. That is, the retainer 186 is made of an U-shaped spring member so that one end of the spring member is closed and the other end is opened, of which the closed end portion is rotatably mounted to the closing cap 170. Explaining with regard to this point, firstly a connector plate 188 is disposed on the outer end surface of the closed cap 170, and a hole for inserting the portion of supporting tube 178 protruded from the closing cap 170 is formed at the center of the connector plate 188. A fixing bolt 190 is screwed into the closing cap 170 through the closed end portion of the retainer 186 and the connector plate 188. Therefore, the retainer 186 is rotatably mounted on the fixing bolt 190 by a nut 192 screwed on the fixing bolt 190. On the other hand, both legs **186*a* of the retainer 186 are extended so as to grip the protruded end portion of the actuator rod 182, and center portion of both legs 186*a* is engaged with an annular groove 182*a* formed on the outer peripheral surface of the protruded end portion of the actuator rod 182 as shown in FIG. 14**.

And, An O-ring 194 is provided on the outer peripheral surface of the actuator rod 182 which is located at the small diameter portion of the stepped hole 180 of the supporting pipe 178. The other end portion, i.e., inner end of the actuator rod 182 is extended into the large diameter portion of the stepped hole 180. A flange 196 is integrally formed at the inner end of the actuator rod 182. A compression coil spring 198 is disposed between the flange 196 and a step surface **180*a* dividing the small diameter portion and the large diameter portion within the stepped hole 180. The compression coil spring 198 always urges the actuator rod 182 toward the high pressure bomb 172. The extension stroke of the compression coil spring 198 is established sufficiently larger than a distance between the inner end of the actuator rod 182 and the mouth portion 174 of high pressure bomb 172 in viewing on a state of FIG. 13**.

A breaking needle 200 is projected from the inner end surface of the actuator rod 182. The breaking needle 200 is made of a hollow pipe member having a tip end for breaking the seal 176 of the high pressure bomb 172, and its internal passage is communiated with a radial hole 202 formed in the actuator rod 182. The radial hole 202 is opened on the outer peripheral surface of the actuator rod 182. That is, the radial hole 202 is communicated with a receiving chamber 204 for the compression coil spring 198 defined between the actuator rod 182 and the supporting pipe 178.

A plurality of communicating holes 206 are formed in the peripheral wall of the supporting pipe 178 and located between the mouth portion of high pressure bomb 172 and the actuator rod 182. These communicating holes 206 are never closed by the flange 196 of the actuator rod 182 even if in a state that the actuator rod 182 is abutted to the mouth portion 174 of the high pressure bomb 172. Consequently, the communicating holes 206 are positioned with keeping larger distance than the width of the flange 196 from the mouth portion 174 of high pressure bottle 172.

Figure 15:
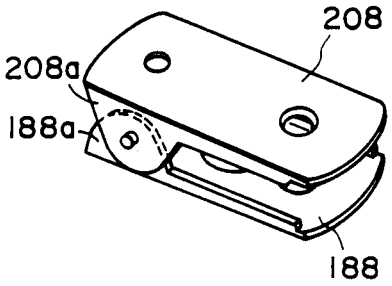
FIG. 15 is a perspective view of a pair of connector plates.

The aforementioned connector plate 188 has a pair of semicircular bracket portions 188*a* which are integrally formed at the position of the fixing bolt side on both side edge of the connector plate 188. The connector plate 188 structures a fixing section 212 for a temperature sensor by cooperating with other connector plate 208 having same shape with the connector plate 188. That is, the connector plate 208 is disposed oppositely to the connector plate 188 as will be clear from FIG. 15. A pair of bracket portions 208*a* are superposed with the corresponding bracket portions 188*a* of the connector plate 188, and these bracket portions are connected each another by means of a pin 210. Accordingly, the connector plate 208 is rotatable around the the pin 210 relative to the connector plate 188.

A guide shaft 214 is provided on the closing cap 170 opposite to the fixing bolt 190 and distanced apart in the diametric direction of this closing cap 170. The guide shaft 214 has threaded portion 214*a* at one end portion and the threaded portion 214*a* is screwed into the closing cap 170. The other end portion of the guide shaft 214 extends through the connector plate 188. A slider ring 216 is slidably mounted on the portion of the guide shaft 214 so as to be located between the connector plates 188 and 208 as will be clear from FIG. 16. The slider ring 216 has a tapered portion 218 which is reduced its diameter toward the closing cap 170, and the smaller diametric portion of this tapered portion 218 is clamped between the two legs 186*a* of the retainer 186. In a state shown in FIGS. 13 and 16, a safety pin 220 as shown in FIG. 17 is arranged so as to clamp the guide shaft 214 between the connector plate 188 and the slider ring 216. The safety pin 220 has a function to prevent that the slider ring 216 will moved unnecessarily toward the closing cap side.

A coil 222 made of a shape memory alloy is disposed between the slider ring 216 and the connector plate 208. The coil 222 has a property, for example, to extend when the temperature of environment would be reached at 70°±5° C. That is, not only the coil 222 serves as a temperature sensor, but also it serves as an actuator for actuating the slider ring 216.

Figure 16:
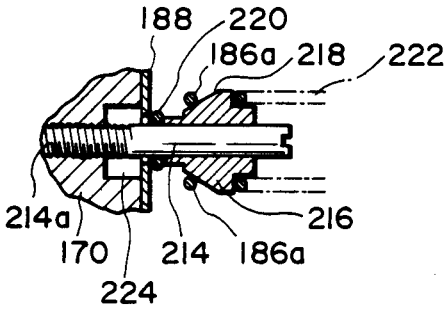
FIG. 16 is a cross sectional view for showing an arrangement of a coil made of a shape memory alloy, slider ring and retainer.
Figure 17:
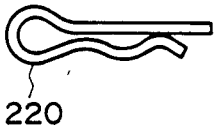
FIG. 17 is a plan view of safety pin.
Figure 18:
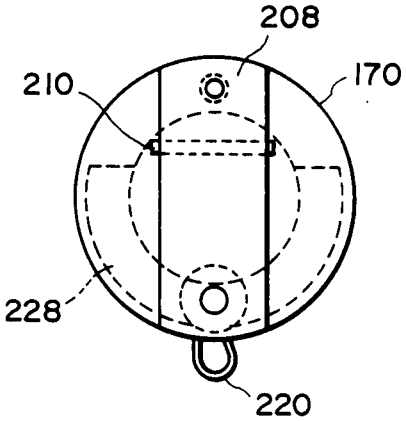
FIG. 18 shows an end surface of discharge unit.

Further, a relief hole 224 for ensuring sufficiently the moving distance of the slider ring 216 is formed in the connector plate 188 and the closing cap 170 as shown in FIG. 16. As shown in FIG. 3, an annular groove 226 is formed on the outer peripheral surface of the closing cap 170, and an attachement 228 for contacting with the front end of threaded portion 214*a* of the guide shaft 214 is fitted into the annular groove 226. The attachment 228 is made of synthetic resin and formed of circular arc shape as will be clear from FIG. 18.

Figure 12:
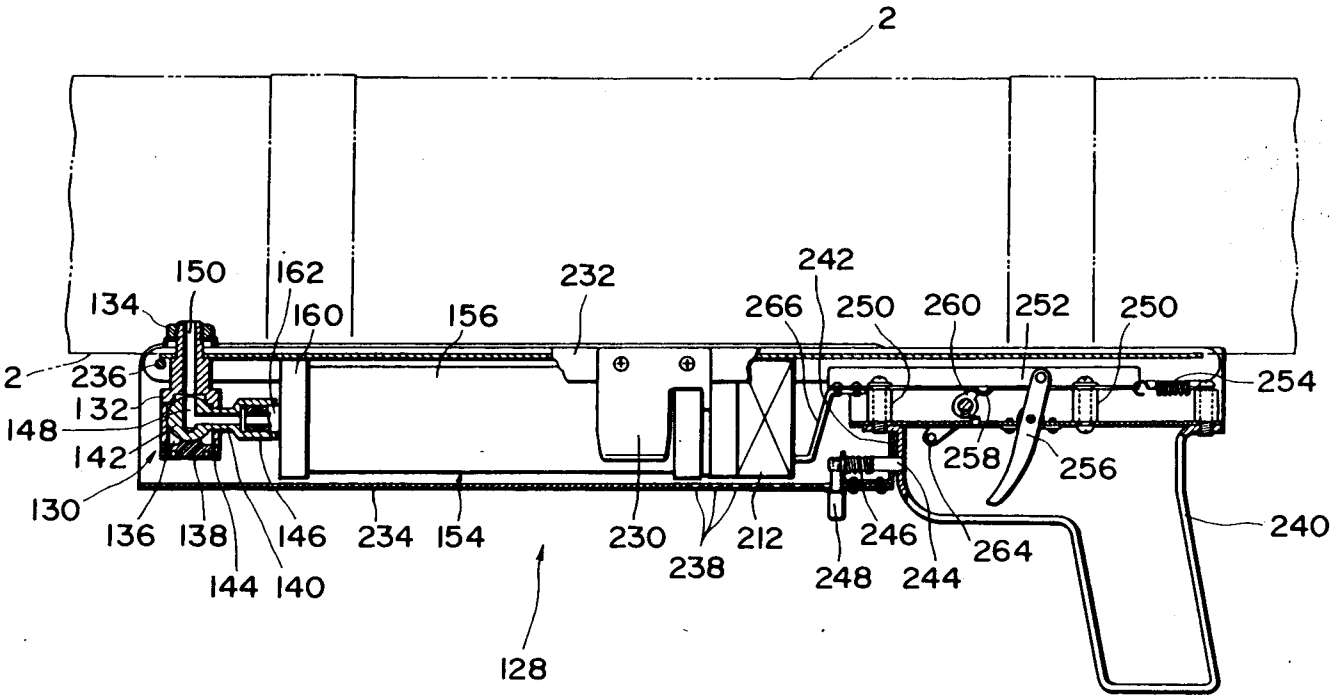
FIG. 12 is a cross sectional view for showing a discharge unit and trigger.
Figure 19:
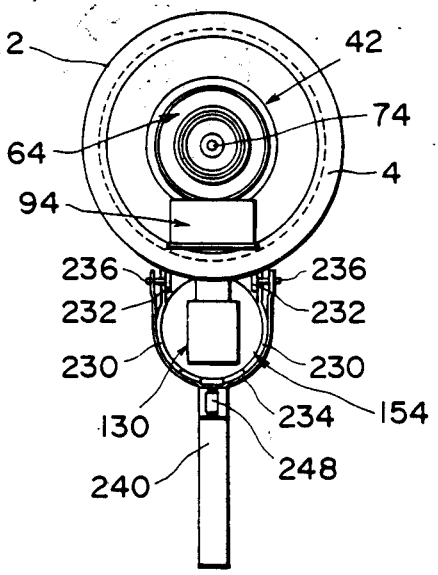
FIG. 19 is a front elevational view of extinguishing apparatus.

Aforementioned discharge unit 154 is held, as shown in FIGS. 12 and 19, so as to be embraced along the cartridge casing 2 by means of a pair of holders 230 made of leaf spring. That is, a pair of fixing plates 232 are fixed at the lower portion of the casing 2. The fixing plates 232 are extended to the axial direction of the casing 2, and the holders 230 are respectively fixed oppositely at the central portion of the corresponding fixing plate 232.

Further, the discharge 154 unit and the joint 130 are covered from downward by a cover 234 formed with U-shape in sectional shape, and one end portion of the cover 234, i.e., the end portion of front cap side of the cartridge casing 2 is rotatably mounted to the fixing plates 232 by means of a pair of pins 236. A plurality of slits 238 are formed to the other end portion of the cover 234. These slits 238 are arranged so as to correspond to a location of the fixing section 212 of aforementioned temperature sensor, i.e., the coil 222.

Further, the other end portion of the cover 234 is detachably coupled to a frame-like handle portion 240. That is, as shown in FIG. 12, an end wall 242, which is contact with the handle portion 240, is provided at the other end portion of the cover 234, and the end wall 242 and the handle portion 240 are coupled together by a connection pin 244. The connection pin 244 is urged in a direction of drawing out of the handle portion 240 by a compression coil spring, however, in a state shown in FIG. 12, the displacement of the connection pin 244 is blocked by a lock lever 248 provided to the cover 234. Furthermore, when the lock lever 248 is handled manually, the connection pin 244 becomes drawn out of the handle portion 240 by action of the urging force of the compression coil spring 246, and according to this, the coupling between the cover 234 and the handle portion 240 can be released.

A sliding plate 252 is slidably mounted at the top of the handle portion 240 by means of two spacers 250. Each head portions of the spacers 250 are penetrated through slots of the sliding plate 252. The slots extends in the axial direction of the cartridge casing 2, therefore, the sliding plate 252 becomes possible to slide within a predetermined range in the direction of approaching to and leaving from the discharge unit 154. A tension coil spring 254 is suspended between the handle portion 240 and the end portion of the sliding plate 252 opposite side to the discharge unit 154.

The handle portion 240 has a trigger 256 of which the central portion is rotatably supported to the handle portion 240 and the top end thereof is rotatably coupled to the sliding plate 252. A protrusion 258 is formed on the lower surface of the sliding plate 252, and a hooking nail 260 is hooked to the protrusion 258. The hooking nail 260 is rotatably supported by cover plates 262 which are mounted on the upper portion of the handle 240, and therefore as far as the hooking nail 260 is engaged to the protrusion 258, sliding of the sliding plate 252 directing to the discharge unit 154, that is, the operation of the trigger 256 becomes disabled. Further, the engagement of the hooking nail 260 with the protrusion 258 can be released by handling a releasing lever 264 connected to the hooking nail 260.

Figure 13:
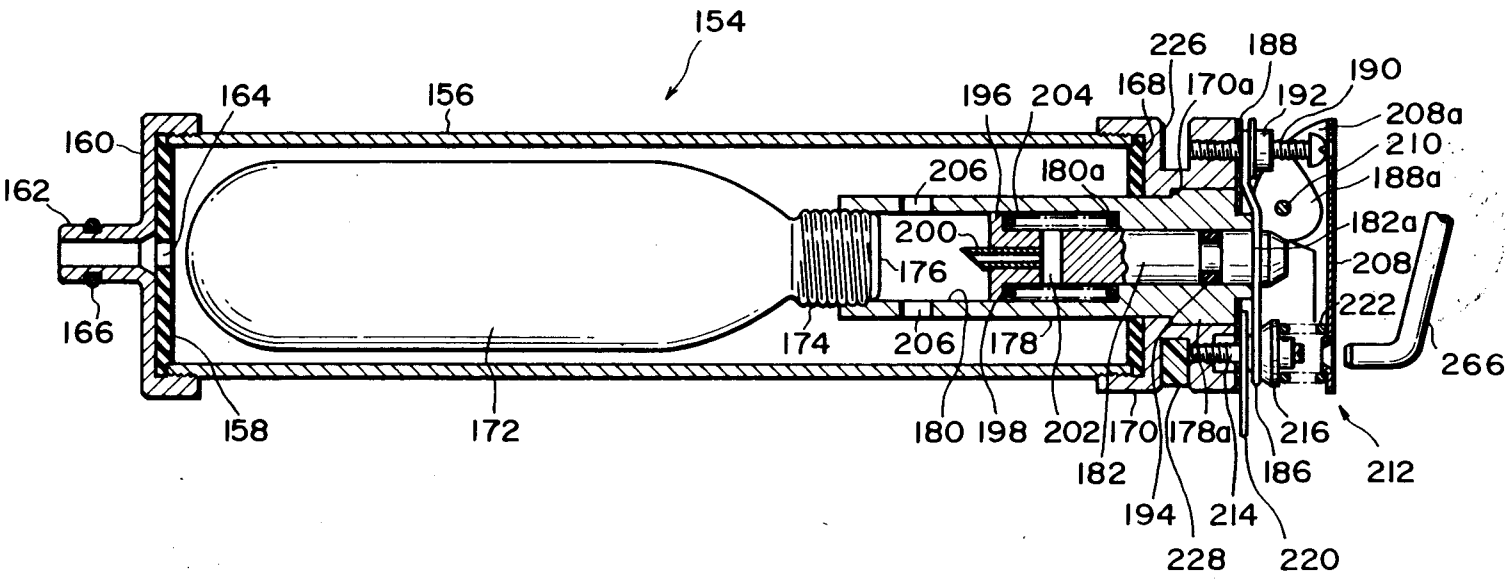
FIG. 13 is a detailed cross sectional view of discharge unit.

An actuator arm 266 is fixed to the end portion of the sliding plate 252 which is positioned at the discharge unit side. The actuator arm 266 extends from the sliding plate 252 toward the discharge unit 154, and its front end is, as shown in FIG. 13, positioned so as to be close to the connector plate 208.

It will be described with respect to the operation of the extinguishing apparatus hereinafter.

Figure 20:
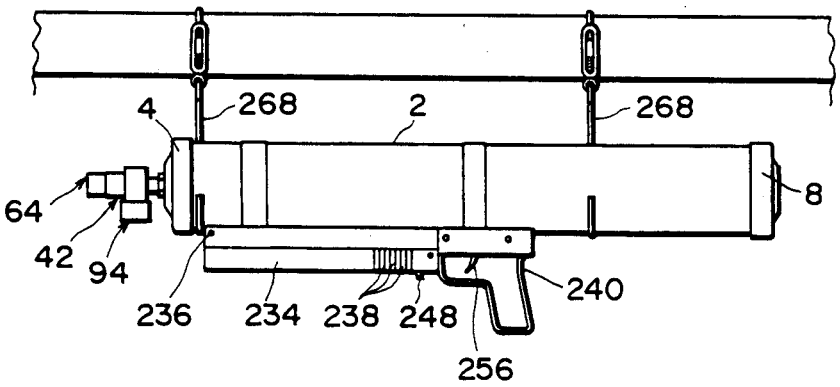
FIG. 20 is a side view for showing an using condition of the extinguishing apparatus.

The extinguishing apparatus can be set, as shown in FIG. 20, by hanging horizontally by means of suspending hooks 268 at appropriate location of a house, a building, and the like. It is assumed that the slider 86 of the jet nozzle device 4 in the extinguishing apparatus is set at the switched position shown in FIG. 3 and the safety pin 220 of the discharge unit 154 is drawn away. Accordingly, as will be clear from FIG. 16, the slider ring 216 is made possible to move toward the closing cap 170 on the guide shaft 214 in a state that the slider ring 216 is held between the coil 222 made of the shape memory alloy and the two legs 186*a* of the retainer 186.

In a state that the extinguishing apparatus of this invention is thus set, if in the case that a fire is broken up, firstly the discharge unit 154 is operated. That is, when the air of the environment of the extinguishing apparatus is heated by the fire, and the temperature of the coil 222 in the discharge unit 154 is reached over 70°±5° C. by this heated air, then this coil 222 is extended. Here, since a plurality of the slit 238 are formed on the cover 234 for the discharge unit 154, the heated air of the environment can be easily reached the coil 222 of the discharge unit through the slits 238. Accordingly, the responsibility of the coil 222 to the outbreak of fire is enhanced, and the fire can be rapidly detected.

Thus, when the coil is extended by the outbreak of a fire, the slider ring 216 is moved so as to be pushed into the the relief hole 224 (refer to FIG. 16) of the closing cap 170 and then the tapered portion 218 of the slider ring 216 becomes to push and open the two legs 186*a* of the retainer, as shown by 2 dot chain line in FIG. 14. Thus, when the retainer 186 is pushed and opened, the two legs 186*a* of the retainer 186, which has been engaged with the annular groove 182*a* of the actuator rod 182, now are released from the annular groove 182*a*, and the actuator rod 182 rushes toward and strikes the mouth portion 174 of the high pressure bomb 172 by the urging force of the compression coil spring 198. Since the hollow breaking needle 200 is projected from the inner end surface of the actuator rod 182, this breaking needle 200 pushes and breaks the seal 176 and enters into the interior of the mouth portion 174 of the high pressure bomb 172. Accordingly, the mouth portion 174 is opened. Therefore, the high pressure fluid contained within the pressure bomb 172 is flowed out to the receiving chamber 204 of the compression coil spring 198 through the breaking needle 200 and the radial holes 202, and then flowed into the interior of the unit casing 156 from the receiving chamber 204 through the communicating holes 206 of the supporting pipe 178. Thereafter, the high pressure fluid within the unit casing 156 is flowed into the interior of the cartridge casing 2 through the connector pipe 162 of the connector cap 160 and the joint 130.

Figure 9:
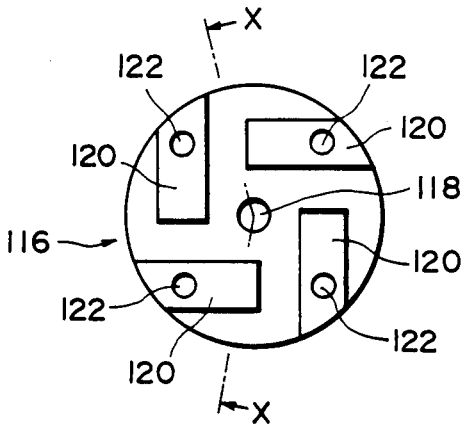
FIG. 9 is a front elevational view of spray disc contained within downward jet nozzle.
Figure 10:
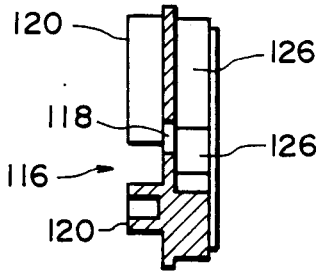
FIG. 10 is a cross sectional view taken along a line X—X in FIG. 9.
Figure 11:
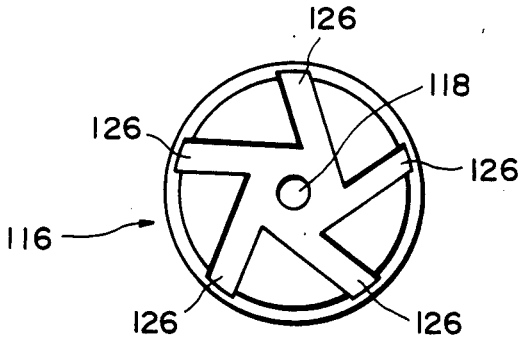
FIG. 11 is a rear view of spray disc of FIG. 9.

Thus, when the high pressure fluid is flowed into the interior of the casing 2, as will be clear from FIG. 2, the pressure in the casing 2 is increased at a high level and the cartridge 22 charged with the extinguishing liquid is then compressed by the high pressure in the casing 2. As a result, the sealing film 30 of the cartridge 22 is broken down, and the extinguishing liquid in the cartridge 22 is flowed out from the connector plug 32 into the rearward passage 56 of jet the nozzle device 42 through the connecting pipe 36. Since the rearward passage 56 of the inlet pipe 44 is coupled to the downward jet nozzle 94 through the port 60 and the annular groove 88 as shown in FIG. 3, the extinguishing liquid is jetted to downward from its jet hole 106 by passing through the interior of the downward jet nozzle 94. As the spray disc 116 shown in FIGS. 9 to 11 is contained within the interior of the downward jet nozzle 94, the jet flow of the extinguishing liquid from the jet hole 106 to downward becomes a conical shape of wide angle.

In above-described case, since the slider 86 of the jet nozzle device 42 is set to the switched position shown in FIG. 3, the extinguishing liquid is jetted from the the downward jet nozzle 94 to downward, however, in case when the slider 86 is switched to the switched position shown in FIG. 4, the extinguishing liquid is jetted from the frontward jet nozzle 64 to frontward. That is, in this case, the extinguishing liquid can be flowed from the rearward passage 56 to the frontward passage 58 through the ports 60, the annular groove 92 and the ports 62, as will be clear from FIG. 4. Thereafter, the extinguishing liquid is flowed from this frontward passage 58 to the front jet nozzle 64 and then jetted from the the jet hole 74 of the frontward jet nozzle 64 to frontward. Since the spray disc 78 is contained within the frontward jet nozzle 64 as well in here, the extinguishing liquid jetted from the jet hole 74 of the front jet nozzle 64 becomes the jet flow formed with conical shape of wide angle.

The extinguishing apparatus of this invention, as aforementioned, detects a heat due to a fire, and then can jet automatically the extinguishing liquid from either side of the frontward and downward jet nozzles 64, 94 of the jet nozzle device 42, however, the extinguishing liquid may be jetted from the jet nozzle device 42 by manually as well. That is, in the case that a fire is broken out at a place distanced apart from the set place of the extinguishing apparatus, user can take out the extinguishing apparatus from the suspended hooks 268, holding this extinguishing apparatus, and one can go to the proximity of fire broken out place. In this case, the slider 86 of the jet nozzle device 42 of the extinguishing apparatus is desirable to be switched to the switched position of FIG. 4, and, it is assumed that the coupling between the hooking nail 260 and the protrusion 258 shown in FIG. 12 has already released by handling the releasing lever 264 by an user.

Thereafter, the user holds the front portion of the extinguishing apparatus by one hand and grasps the handling portion 240 by another hand so as to direct the frontward jet nozzle 64 toward fire site, and then one can pull the trigger 256 of the handle portion 240. When this trigger 256 is pulled, the actuator arm 266 is advanced toward the discharge unit 154 through the sliding plate 252, as will be clear from FIG. 13, and then press the connector plate 208 of the discharge unit 154. Since the connector plate 208 is rotatable by means of the pin 210 relative to the connector plate 188, the connector plate 208 is turned by the actuator arm 266, and makes to move so as to push the slider ring 216 through the coil 222 toward the relief hole 224 of the closing cap 170. As a result, as aforementioned, the holding of the actuator rod 182 by the retainer 186 is released, whereby the extinguishing liquid is jetted from the frontward jet nozzle 64 of the jet nozzle device 42.

Figure 21:
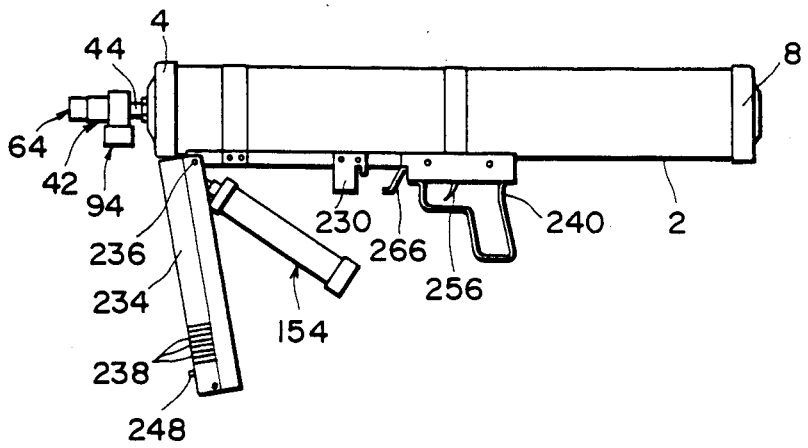
FIGS. 21 and 22 show the exchanging sequence of cartridge and discharge unit.

After the extinguishing liquid contained within the cartridge 22 is exhausted, a new cartridge 22 filled with the extinguishing liquid is charged into the cartridge casing 2, and a new discharge unit 154 is coupled to the joint 130 as well, whereby the re-use of the extinguishing apparatus becomes possible. That is, with respect to the exchange of the exhausted discharge unit 154, firstly, the cover 234 is opened as shown in FIG. 21, and the exhausted discharge unit 154 is taken out of the holders 230, and then this discharge unit 154 is drawn out of the movable tube 140 of the joint, whereby it can be released. With respect to the exchange of the cartridge 22, at first, the rear cap 8 of the cartridge casing 2 is rotated and taken away, and the knob portion 22a of the cartridge 22 is gripped by hand and drawn therefrom, whereby the cartridge 22 can be taken away from the casing 2.

Figure 22:
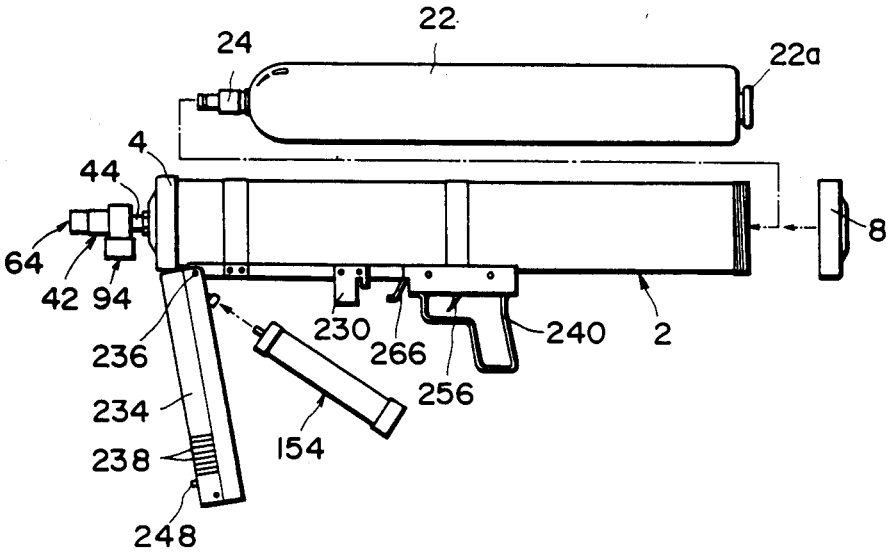

Thereafter, as will be clear from FIG. 22, a new discharge unit 154 and a new cartridge 22 can simply and rapidly be charged respectively by executing reverse sequence of the aforementioned taking away sequence.

Therefore, according to the extinguishing apparatus of this invention, successive use of the extinguishing apparatus becomes possible by preparing previously the cartridge 22 and the discharge unit 154 in large number.

What is claimed is:

1. Extinguishing apparatus comprising:

a hollow cartridge casing, said cartridge casing including a closed end and an opened end;

a jet nozzle device mounted to the closed end of said cartridge casing, said jet nozzle device including a discharge pipe extending into said cartridge casing by passing through the closed end of said cartridge casing in airtight manner from outside, and at least one jet nozzle mounted to a protruded portion of the discharge pipe from the cartridge casing;

a cartridge inserted from the opened end of said cartridge casing therein, said cartridge including a flexible tube closed with both ends, extinguishing material having fluidity charged within the tube, a discharge outlet protruded from an end of the cartridge positioned at the discharge pipe side in the inserted state of said cartridge into said cartridge casing, and sealing means for blocking the discharge outlet, and for opening the discharge outlet when said cartridge is compressed by a predetermined force from outside;

connecting means for coupling detachably the discharge outlet of said cartridge in plug-in manner to the discharged pipe of the jet nozzle when said cartridge is inserted into said cartridge casing;

a cap for closing the opened end of said cartridge casing which is detachably mounted in screwing manner to the opened end;

a joint pipe mounted to the outer wall of said cartridge casing, one end of said joint pipe is opened to the interior of said cartridge casing and the other end is opened to the outside of said cartridge casing;

a discharge unit for discharging incombustible high pressure fluid through said joint pipe into said cartridge casing when detecting a predetermined temperature, said discharge unit including a hollow unit casing, joint means for detachably coupling the unit casing in plug-in manner to said joint pipe, a high pressure bomb contained within the unit casing and charged with high pressure fluid therein as well as having a closed outlet for discharging the high pressure fluid, and releasing means of heat responsive type for opening the closed outlet of the high pressure bomb when the temperature of environment would be reached over a predetermined temperature, the releasing means having a heat sensitive operational section exposed at the outside of the unit casing;

holding means for detachably holding said discharge unit connected with said joint pipe to said cartridge casing; and trigger means which is mounted separately with said discharge unit and may be actuated by the manual handling of the heat sensitive operational section of the releasing means regardless of temperature.

2. Extinguishing apparatus according to claim 1, wherein the jet nozzle of said jet nozzle device is fixed by screwing into the discharged pipe, and said jet nozzle device further includes a second jet nozzle which is different in jetting direction from the jetting direction of the first jet nozzle, and switching means for coupling either one of the first and second jet nozzle with the discharge pipe selectively by manual.

3. Extinguishing apparatus according to claim 2, wherein the switching means comprising: a partitioning wall for partitioning the interior of the portion of the discharge pipe protruded from said cartridge casing to a frontward passage of the first jet nozzle side and a rearward passage of the cartridge casing side, a frontward port which is formed on the discharge pipe and opened to the frontward passage, a rearward port which is formed on the discharged pipe and opened to the rearward passage, a slider which is located at the outside of said cartridge casing, the slider being mounted on the discharged pipe and coupled with second jet nozzle, a first annular groove which is formed on the inner surface of the slider, the first annular groove being communicated with the rearward port for the second jet nozzle when the slider is positioned at a first position in viewing from the axial direction of the discharged pipe, and a second annular groove which is formed on the inner surface of the slider, the second annular groove connecting the frontward port to the rearward port when the slider is positioned at the second position in viewing the axial direction of the discharge pipe.

4. Extinguishing apparatus according to claim 3, wherein the first jet nozzle has a jetting direction of extinguishing material for directing to frontward of the discharge pipe, and the second jet nozzle has a jetting direction of extinguishing material for directing to sideward of the discharge pipe.

5. Extinguishing apparatus according to claim 1, wherein said connecting means includes a socket formed at the end portion of the discharge pipe positioned within said cartridge casing, and a connector plug which is provided to the discharge outlet of said cartridge and detachably inserted to the socket of the discharge pipe.

6. Extinguishing apparatus according to claim 1, wherein the joint means includes a socket provided at the other end of the joint pipe, and a connector pipe which is provided to the unit casing of said discharge unit and detachably inserted to the socket.

7. Extinguishing apparatus according to claim 1, wherein the releasing means of said discharge unit includes an actuator rod capable of rushing toward the closed outlet of the high pressure bomb, a breaking needle which is provided to the actuator rod and colliding to the closed outlet thereby breaking down the closed outlet, and a mechanism for blocking the rush of the actuator rod.

8. Extinguishing apparatus according to claim 6, wherein the heat sensitive operating section includes a coil made of a shape memory alloy which extends when it is heated over a predetermined temperature.

* * * * *